US005313242A

United States Patent [19]

Devaney, Jr. et al.

[11] Patent Number: 5,313,242

[45] Date of Patent: May 17, 1994

[54] THRU-WALL WEB PROCESSING APPARATUS

[75] Inventors: Mark J. Devaney, Jr.; John S. Lercher, both of Rochester, N.Y.

[73] Assignee: Eastman Kodak Company, Rochester, N.Y.

[21] Appl. No.: 54,487

[22] Filed: Apr. 27, 1993

[51] Int. Cl.[5] ..... G03D 3/08

[52] U.S. Cl. ..... 354/319; 354/320; 354/321; 354/324

[58] Field of Search ..... 354/317-329, 354/338, 339, 340

[56] References Cited

U.S. PATENT DOCUMENTS

| | | | |
|---|---|---|---|
| 2,918,069 | 1/1958 | Brown | 134/122 |
| 3,057,282 | 4/1959 | Luboshez | 95/89 |
| 3,120,795 | 3/1959 | Land | 95/90 |
| 3,277,810 | 10/1966 | Hersh | 95/94 |
| 3,662,660 | 5/1972 | Layne | 95/89 |
| 4,023,190 | 5/1977 | Fassler | 354/319 |
| 4,101,919 | 7/1978 | Ammann | 354/319 |
| 4,142,194 | 2/1979 | Hamlin | 354/318 |
| 4,166,688 | 9/1979 | Sachs | 354/319 |
| 4,166,689 | 9/1979 | Schausberger | 354/321 |
| 4,187,023 | 2/1980 | Schausberger | 354/321 |
| 4,303,330 | 12/1981 | Hehn | 354/319 |
| 4,324,479 | 4/1982 | Sachs | 354/319 |
| 4,327,988 | 5/1982 | Vanhorebeek | 354/320 |
| 4,515,456 | 5/1985 | Ferrante | 354/320 |
| 4,577,949 | 3/1986 | Geyken | 354/319 |
| 4,588,277 | 5/1986 | Buckler | 354/317 |
| 4,616,915 | 10/1986 | Norris | 354/320 |
| 4,758,857 | 7/1988 | Tanaka | 354/320 |
| 4,875,067 | 10/1989 | Kanzaki | 354/325 |
| 4,933,699 | 6/1990 | Nakamura et al. | 354/320 |
| 4,941,008 | 7/1990 | Nakamura | 354/320 |
| 4,965,618 | 10/1990 | Devaney | 354/317 |
| 4,977,422 | 12/1990 | Vaughan | 354/317 |
| 4,980,714 | 12/1990 | Nakamura | 354/322 |
| 4,987,438 | 1/1991 | Goto et al. | 354/319 |
| 4,994,837 | 2/1991 | Samuels et al. | 354/299 |
| 4,994,840 | 2/1991 | Hall | 354/324 |
| 5,043,756 | 8/1991 | Takabayashi et al. | 354/320 |
| 5,047,795 | 9/1991 | Keable et al. | 354/320 |
| 5,059,997 | 10/1991 | Hall | 354/324 |
| 5,066,570 | 11/1991 | Nakamura | 430/421 |
| 5,108,878 | 4/1992 | Nakamura | 430/421 |

*Primary Examiner*—D. Rutledge
*Attorney, Agent, or Firm*—Peter J. Bilinski

[57] ABSTRACT

An improved thru-wall structure useful for apparatus for processing photosensitive material for separating adjacent chambers filled with processing fluids. The wall structure having first and second wall portions and a pair of sidewall portions which define a passage opening. A pair of parallel contacting rollers are placed into the opening. The rollers have a compliant sublayer which elastically deforms in an radial direction and a outer layer made from a material having a low coefficient of friction to allow the rollers to be easily rotatably driven and providing a fluid seal between the rollers. The rollers are placed within the sidewalls by engaging the roller ends into an opening provided in each sidewall which is slightly smaller than the diameter of the combined rollers so as to provide a tight liquid seal at the roller end-sidewall interface.

26 Claims, 10 Drawing Sheets

THRU-WALL WEB PROCESSING APPARATUS

RELATED APPLICATIONS

Reference is made to the following copending and commonly assigned applications filed concurrently herewith:

1). Ser. No. 08/054,810, filed by Mark J. Devaney, Jr., John S. Lercher, Lee F. Frank, Paul W. Wagner and Jeffrey L. Helfer and entitled "Processing Apparatus".

2). Ser. No. 08/054,501 filed by Mark J. Devaney, Jr. and entitled "Processing Apparatus".

FIELD OF THE INVENTION

This invention relates to the processing of photosensitive materials and more particularly to thruwall structures having improved sealing means which are useful for separating processing chambers within a processing apparatus.

BACKGROUND OF THE INVENTION

In the field of film processors, such as those for x-ray film, a sheet of photosensitive material typically undergoes a number of sequential processing steps; that is, at least one developing step, one fixing step, and a washing operation wherein the photosensitive material is brought into contact with a processing liquid (developer, fixer solution, etc.) to produce a desired chemical interaction with the film substrate or to wash chemical residue away from the substrate surface.

Because it is not desirable to intermix processing fluids of differing chemistries due to their generally antagonistic nature, it has been known to place quantities of different processing fluids in separate, discrete chambers positioned within a processing apparatus.

In processors of the prior art, a sheet of photosensitive material is passed through a series of open topped containers, each containing a quantity of processing fluid, by a series of rollers over a generally sinusoidal transport path into and out of each open topped container. A typical processor of this kind is shown in U.S. Pat. No. 4,994,837.

There are a number of disadvantages with a processor of this type. First, the lengthy transport path impedes the ability to realize a high processing throughput. Exposing a film substrate to atmospheric conditions between processing chambers is not conducive to processability because no chemical interaction takes place during exposure; in other words it is nonproductive, or "dead" time. In addition, the photosensitive material is more susceptible to scratching or marring due to the stresses induced as the material remains in substantial contact with the multiple sets of rollers that are required to traverse a serpentine transport path in a processor of this type.

A number of attempts have been made to deal with the problems described. Processing apparatus using more direct transport paths, extending directly through the walls of adjacent closed tank chambers containing processing liquid have been utilized. In processors of this type photosensitive material enters a chamber partially full of a processing liquid through an opening in the chamber wall, the opening being above the level of the processing liquid that is contained therein. The material is then brought into contact with the processing fluid by either pumping additional processing material into the chamber, thereby raising the level of liquid present in the chamber to contact the passing web, or by downwardly conveying the material to the level of processing liquid. Examples of processors of this type are disclosed in U.S. Pat. Nos. 4,023,190 and 4,142,194.

Processors using methods such as those taught by the preceding examples require exposing the photosensitive material to atmospheric conditions for extended periods, prior to immersion into a processing solution, thereby also affecting the throughput of a processing apparatus.

U.S. Pat. No. 4,987,438 discloses a processor in which a continuous sheet of photosensitive material passes directly through an integrated wall structure positioned to separate adjacent closed containers that are filled with a processing fluid, the wall structure having a pair of parallel, contacting rollers which are rotatably driven and disposed therein. The wall structure is sized to receive the web of photosensitive material, and the rollers act as a transport means for moving the web from and through one processing station to the next adjacent station.

It can be seen that a processing apparatus having a through wall structure as described provides a means for the photosensitive material to traverse a direct transport path by way of rollers already incorporated within the wall structure, without the need for additional rollers or other transport means. However, the processors described require a rather complex sealing means, particularly at the interface where the roller end(s) are attached to either the chamber sidewall or the sidewall of the through-wall structure. To provide an effective seal at this interface is relatively difficult because the rollers must be allowed to rotate to allow the web of photosensitive material to pass therethrough, while also preventing the passage through the ends of processing liquid between adjacent chambers. In order to prevent significant leakage of processing liquid between adjacent chambers separated by a thru-wall structure as described requires that either the roller ends be very tightly manufactured (that is, toleranced on the order of thousandths of an inch) to adequately match the roller ends to the sidewall, or that gasketing or other sealing material be used between the sidewall and the roller end. Both of these measures are quite costly, either due to the preciseness of manufacture in the case of the former, or in terms of frictional effects due to wear of the roller ends against the sealing material requiring periodic changing of the rollers or gasketing. Such frequent replacement is particularly significant with high throughput processors because periodic maintenance is costly in terms of expense and downtime.

Therefore, there is a need to provide an improved thru-wall structure which adequately prevents significant cross-contamination between adjacent processing containers at the sidewall-roller interface which is more reliable, and which is easier to manufacture and maintain than current wall structures used for similar purposes.

There is also a need to provide a sealing means for processors having thru-wall web transports which simplifies the design of the rollers such that the length of the rollers is less significant in the forming of a relatively liquid tight seal, thereby reducing the tightness of tolerancing in the sidewall-roller end interface.

SUMMARY OF THE INVENTION

According to the present invention, an internal wall structure for use in an apparatus for processing photosensitive material is provided, the apparatus having at least one chamber for containing a processing fluid, the wall structure forming a portion of the chamber and for allowing the photosensitive material to pass therethrough, the wall structure having a top and a bottom surface and a pair of side surfaces defining a first opening, and at least one pair of substantially parallel contacting rollers, comprising a first and second roller, the roller pair being positioned in said first opening so that said rollers central longitudinal axis is aligned with the centerline of the wall structure, the combined outer diameter of the roller pair being slightly greater than the first opening when the rollers are not positioned within the wall structure, the rollers being radially deformable so as to fit the roller pair within the first opening, the side surfaces each having a recessed portion for receiving the roller ends, each recessed portion defining a second opening which is slightly smaller than the outer diameter of the roller ends.

In another aspect of the invention, an apparatus for processing photosensitive material is provided having a plurality of chambers for containing processing fluids and at least one internal wall structure for dividing at least two of the chambers, the wall structure forming a portion of a chamber and for allowing photosensitive material to pass therethrough, the internal wall structure having a top and a bottom surface and a pair of side surfaces defining a first opening, and at least one pair of substantially parallel contacting rollers being positioned in the first opening so that the rollers central longitudinal axis is aligned with the centerline of the wall structure. The combined outer diameters of the roller pair are slightly greater than the width of the first opening when the rollers are not positioned in the wall structure and the rollers are radially deformable so as to fit the roller pair into the first opening. The chamber having recessed portions for receiving the roller ends, each recessed portion defining a second opening which is slightly smaller than the outer diameter of the roller ends.

Further advantageous features will become apparent upon reference to the following Description of the Preferred Embodiments, when read in light of the attached drawings.

DESCRIPTION OF THE DRAWINGS

FIG. 2(*b*) shows a cross-sectional view also taken along the line 2—2 of a second embodiment of a wall structure made in accordance with the present invention.

DESCRIPTION OF THE PREFERRED EMBODIMENTS

In the description that follows use is made of the terms "upper", "lower", "top", "bottom", etc. to facilitate discussion. This terminology is used only to provide perspective with respect to the accompanying drawings and is not intended to confine application of the present invention described herewith.

Figure 1:
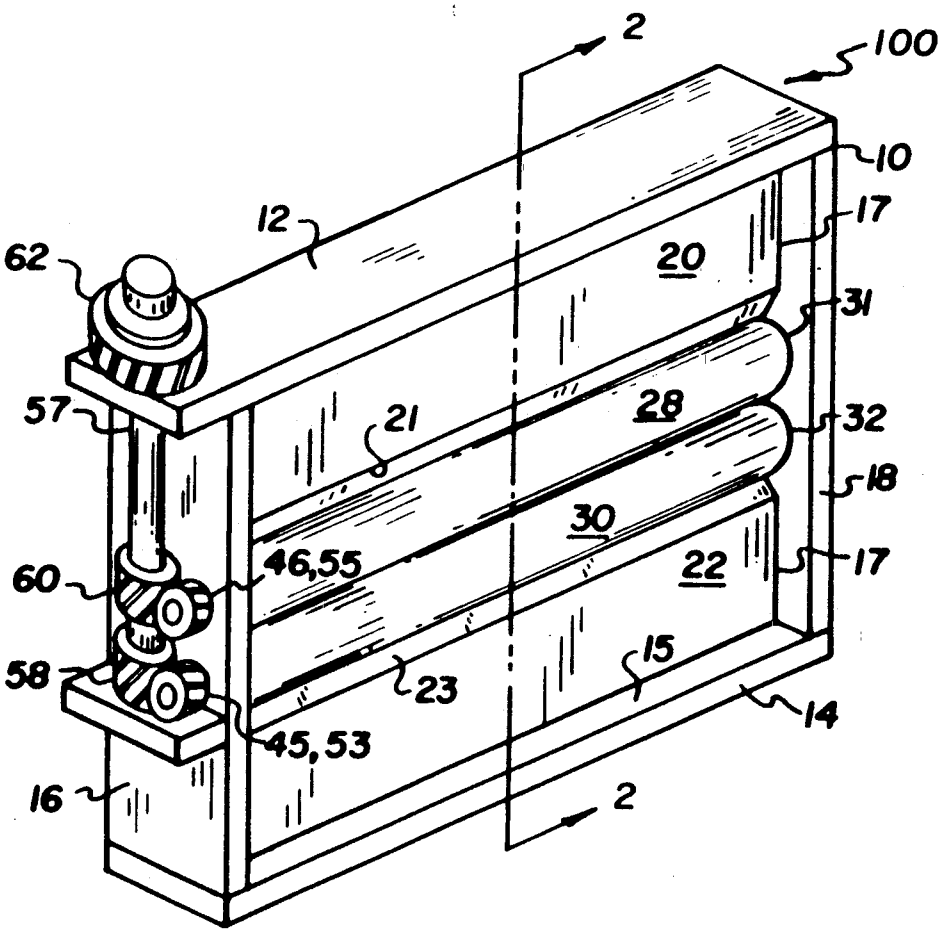
FIG. 1 shows a front perspective view of a wall structure made in accordance with the present invention.
Figure 2A:
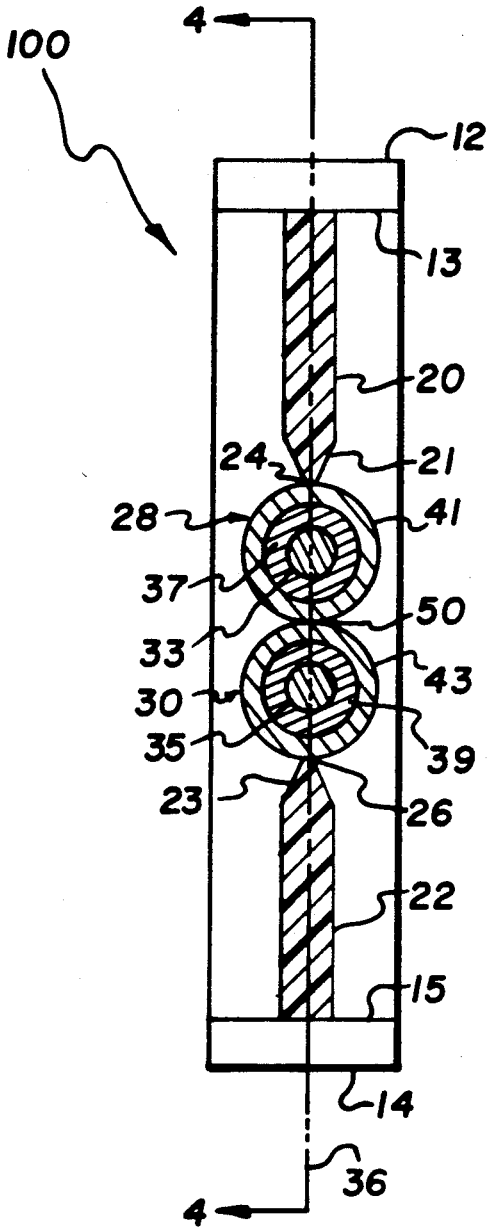
FIG. 2(*a*) shows a cross-sectional view of the wall structure shown in FIG. 1, taken along line 2—2.
Figure 2B:
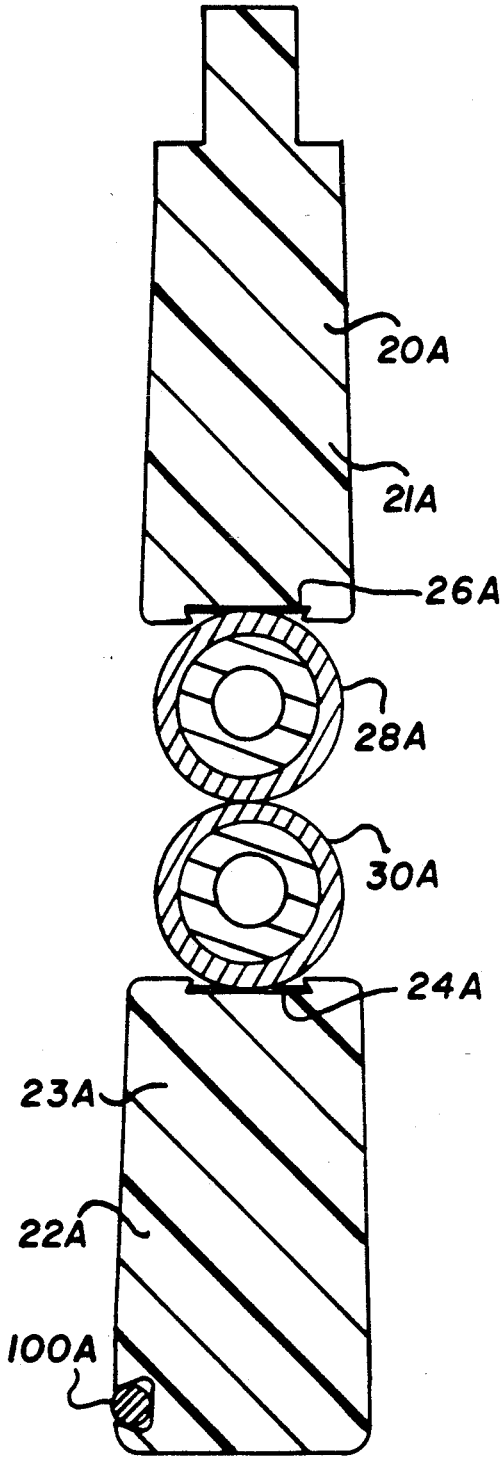

A preferred embodiment of the wall structure made in accordance with the present invention is shown in FIGS. 1 through 7. Referring to FIGS. 1 and 2(*a*), a wall structure 100 is provided, made up of a support frame 10, comprising a top and bottom support 12, 14 respectively, and a pair of sidewalls 16 and 18, which are assembled together using threaded fasteners,(not shown), though other known mounting means can be used. Support frame 10 is made preferably from a lightweight thermoplastic material. In the particular embodiment illustrated support frame 10 is made of Acrylonitrile-Butadiene-Styrene polymer (commonly referred to as ABS), although other suitable materials which are nonreactive in the presence of processing fluid may also be used.

Upper wall member 20 is mounted to the lower surface 13 of top support 12. Similarly, lower wall member 22 is mounted to the upper surface 15 of bottom support 14. The ends 17 of each wall member 20, 22 are fastened to the interior side of sidewalls 16, 18 by known means to provide sealed surfaces at their respective interfaces. Further, wall members 20, 22 are each tapered at their lower and upper ends, 21, 23, respectively, to form rounded wiping surfaces 24, 26.

Wall members 20, 22 can be provided having a variety of configurations to provide an adequate internal wall structure. For example, in another embodiment as shown in FIG. 2(*b*), a wall structure 100A is provided wherein wall members 20A, 22A are slightly tapered and substantially flat wiping surfaces 24A, 26A are inset at ends 21A, 23A, rather than providing rounded ends for providing contact with a pair of rollers 28A, 30A inserted therebetween as discussed below. In addition, wall members 20A, 22A need not be identical, according to FIG. 2(*b*).

Referring to FIGS. 2(*a*) and 3, positioned between wiping surfaces 24, 26 are a pair of substantially parallel contacting rollers, 28, 30, each having a central longitudinal axis 31 and 32, respectively. Each roller 28, 30 comprises a rigid inner core 33, 35 extending over length L, FIG. 4, which is covered over substantially most of its length L1, FIG. 4, by a sublayer 37, 39, made of a compliant/resilient material. An outer layer 41, 43 made of a material having a low coefficient of friction covers compliant sublayer 37, 39.

Figure 3:
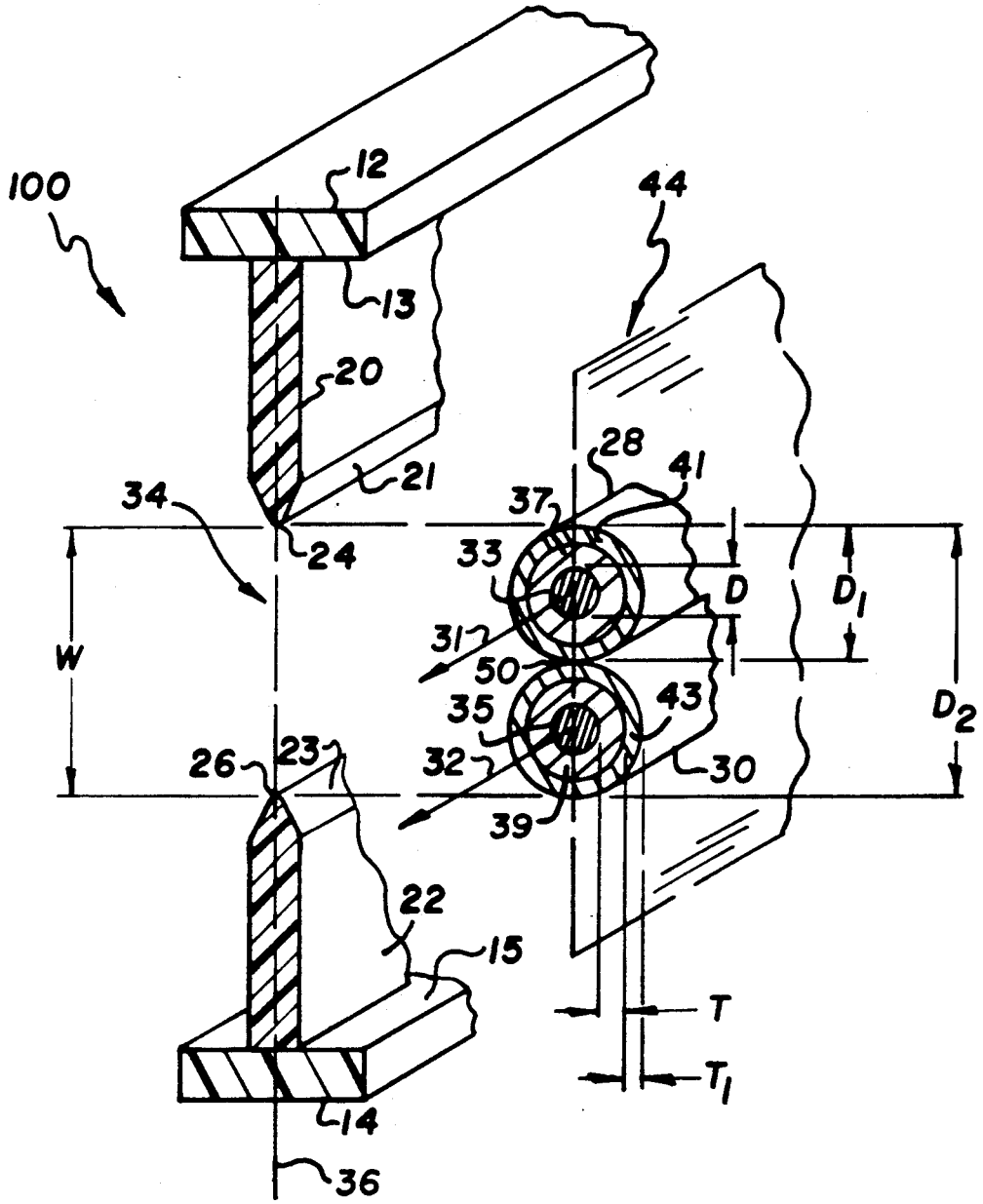
FIG. 3 is a partial exploded cross-sectional view of the wall structure of FIG. 2(*a*), as taken along the line 2—2 of FIG. 1, illustrating the opening defined in the wall structure.

Referring to FIG. 3, rollers 28, 30 are identical in this embodiment, each having steel inner cores 33, 35 having a diameter D of about 1.00 in (2.54 cm), a silicone rubber sublayer 37, 39 having a uniform thickness T of about 0.250 in (0.64 cm) and a substantially uniform outer layer 41, 43 made from PFA, a form of tetrafluoroethylene (Teflon TM) and having a thickness T1 of about 0.005 in (0.012 cm). Further the silicone rubber sublayer 37, 39 preferably has a Shore A hardness of about 20A, though other compliant materials having a Shore A hardness of about 20A to 40A have been found to be acceptable for the present embodiment. The coefficient of friction of outer layer 41, 43 is about 0.10, though this coefficient can be varied. In addition it is preferable, but is not required, that rollers 28, 30 have the same outer diameter, D1.

The positioning of wall members 22, 24 and sidewalls 16, 18 form a longitudinal opening 34 having a width W, as seen most clearly in FIG. 3. In the embodiment illustrated, opening 34 is approximately 0.030" (0.076 cm) smaller than the combined unstressed diameters D2 of rollers 28, 30. Providing the size of opening 34 smaller than the combined outer diameters D2 of the rollers 28, 30 produces an interference fit. This interference fit is produced between the nip 50 of rollers 28, 30, as well as between the individual rollers 28, 30 and adjacent wiping surfaces 24, 26 when rollers 28, 30 are inserted into longitudinal opening 34, as shown in FIG. 2(*a*). The interference fit provides a seal between the rollers and wiping surfaces at each interface.

Preferably, rollers 28, 30 are positioned within longitudinal opening 34 so that roller central axes 31, 32 are substantially parallel. Central axes 31 and 32 form a plane 44, FIG. 3, which is preferably arranged coincident to the centerline 36 of wall structure 100.

Though an interference of 0.010 in (0.254 cm) per interface between the rollers 28, 30 and the opening 34 is useful in this embodiment, the exact amount of interference created between opening 34 and the outer diameters of rollers 28, 30 may be varied to accommodate the material of the rollers. An amount of interference is provided so as to produce an effective seal which will prevent significant quantities of liquid from migrating through wall structure 100. Additional interference must be provided to compensate for any manufacturing tolerance buildups to insure a nominal interference is achieved.

Figure 4:
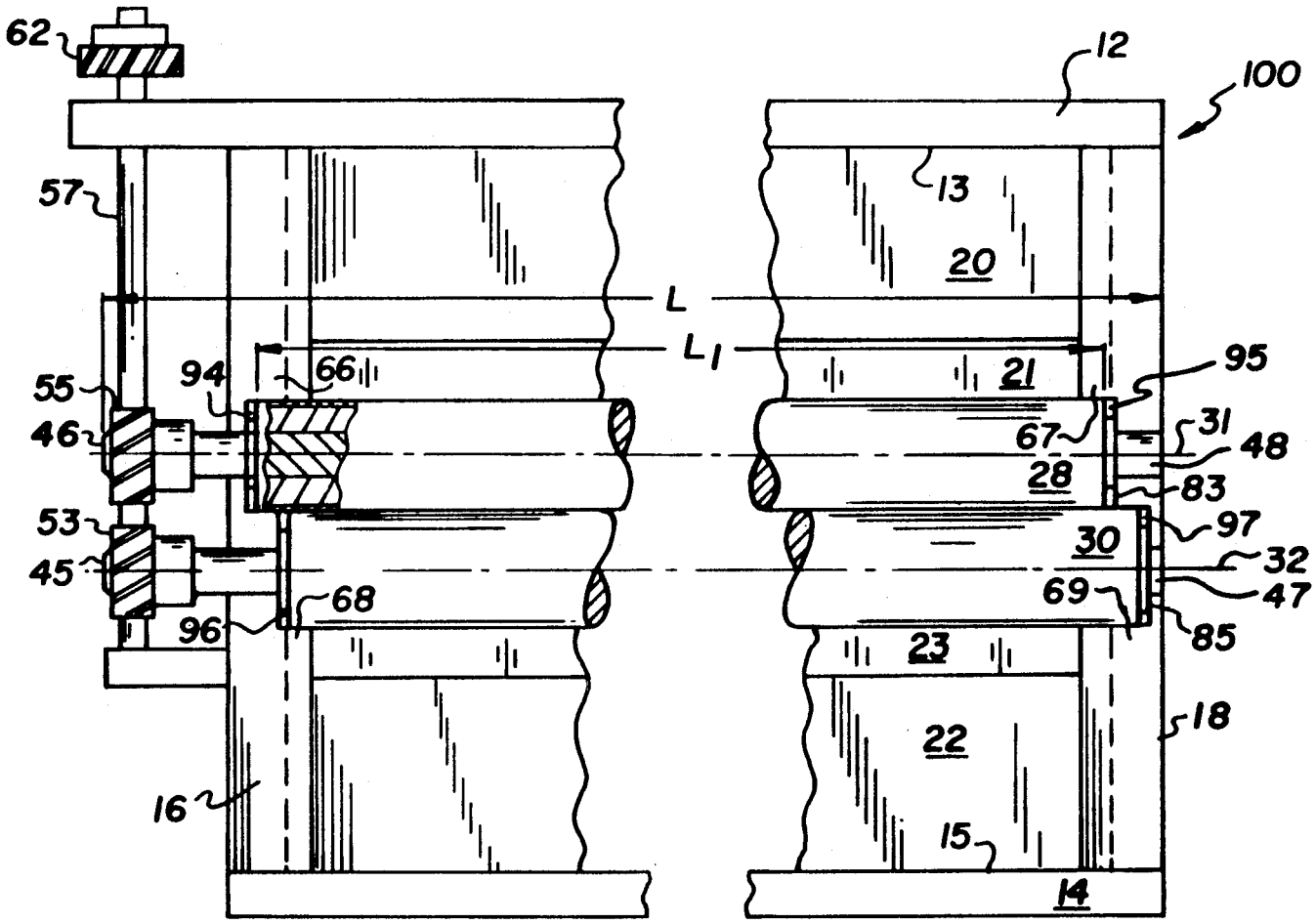
FIG. 4 is an enlarged partial cross-sectional view of the wall structure shown in FIG. 2(*a*) as taken along the line 4—4, showing the placement of transport rollers within the wall structure.

Referring to FIGS. 1 and 4, core shaft end sections 45, 46 extend through clearance holes (not shown) provided in sidewalls 16. Mounted to end sections 45, 46 are left and right hand helical gears 53, 55 respectively, which mate with matching worm gears 58, 60, FIG. 1, mounted to drive shaft 57, vertically extending along the exterior side of sidewall 16. Additional drive gearing 62, provided at the upper end of drive shaft 57, and positioned along top support 12 is engagable with a second drive means. An example of a second drive means is partially shown in FIG. 10 and is described in greater detail in the commonly assigned and copending application, Ser. No. 08/054,810 by Mark J. Devaney, Jr., John S. Lercher, Lee F. Frank, Paul W. Wagner and Jeffrey L. Helfer, filed concurrently herewith and entitled "Processing Apparatus", hereby incorporated by reference. Other conventional driving means, however, may be utilized to drive the rollers 28, 30 and are not considered a part of the present invention. The low frictional coefficient of outer roller surfaces 41, 43 allow rollers 28, 30 to be easily rotated, in spite of the interference fit of the rollers 28, 30 into opening 34. Drive means are only required at one end of the rollers 28, 30. The remaining shaft end sections 47, 48, however, preferably extend into clearance holes (not shown) extending through sidewall 18 to allow for easier roller access.

Figure 5:
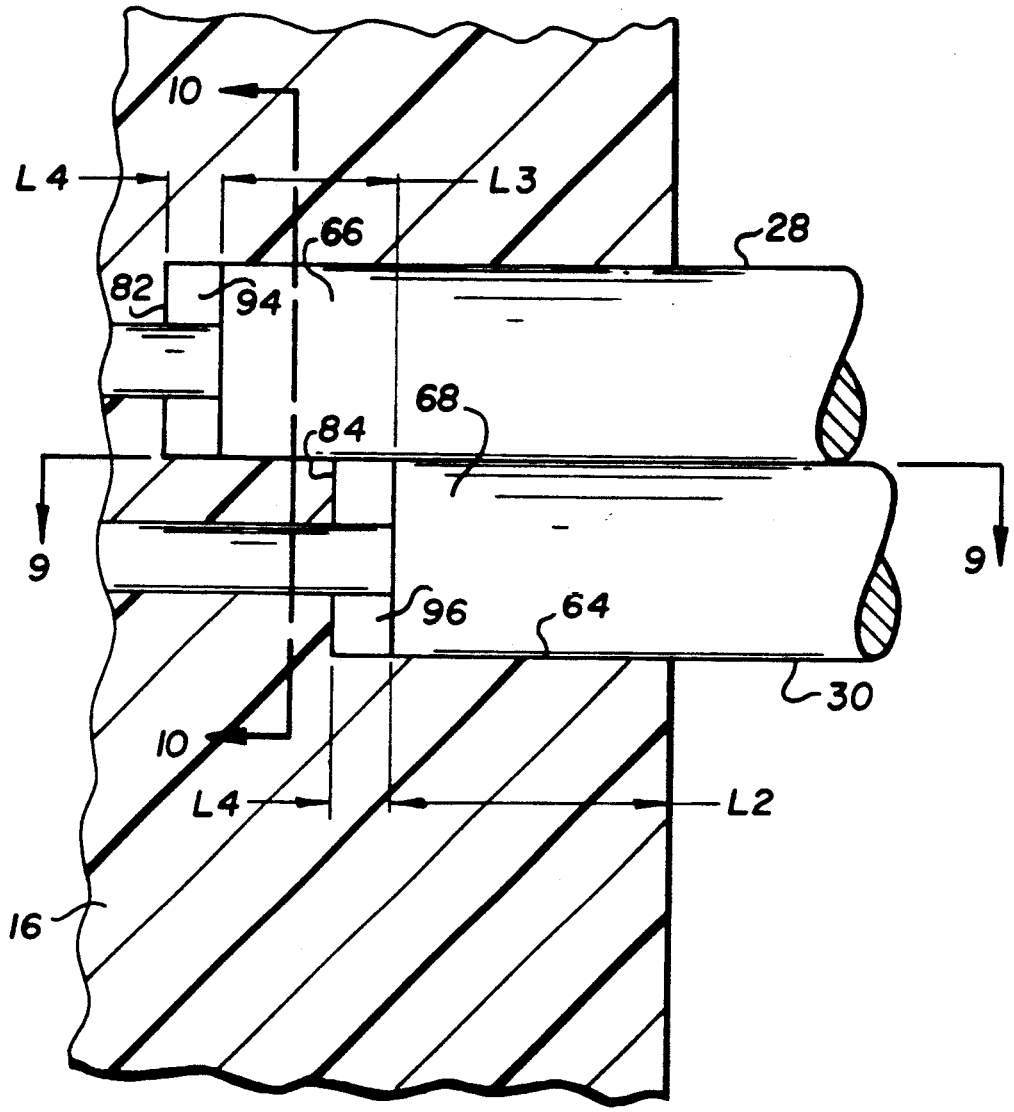
FIG. 5 is an enlarged partial frontal view, shown in section, of the wall structure shown in FIG. 4, and illustrating one roller end-sidewall interface.
Figure 6:
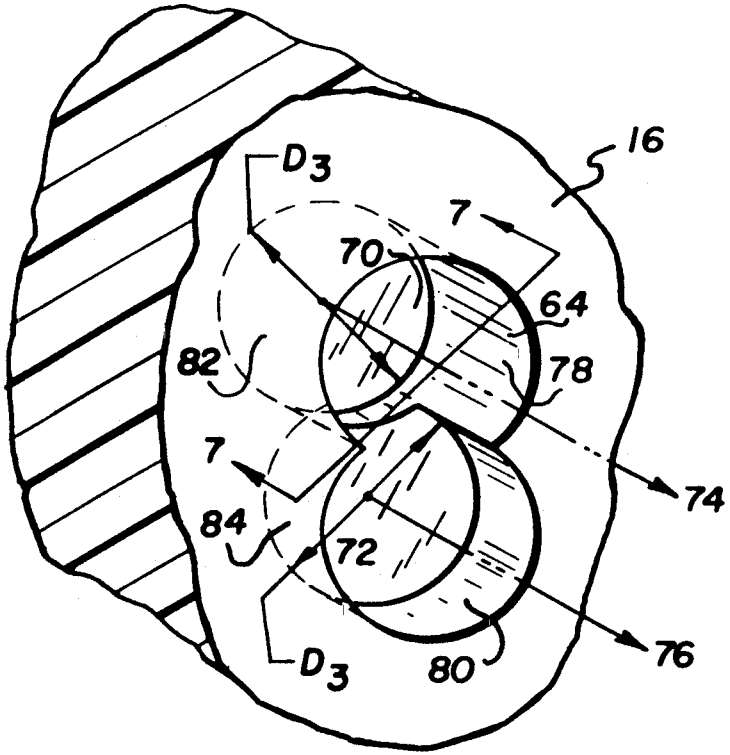
FIG. 6 is an enlarged perspective view of a portion of a sidewall shown in the embodiment of FIG. 5 illustrating the recessed portion used to receive the roller ends.

Referring to FIGS. 4, 5 and 6, sidewall 16 is provided with a recessed portion 64 shaped so as to receive roller ends 66, 68. Recessed portion 64 is preferably defined by two overlapping and substantially circular sections 70, 72, each defined by a diameter D3, and by interior sidewalls 78, 80, respectively, which extend somewhat circumferentially along the interior of sidewall 16. Each circular section 70, 72 is also defined by a central axis 74, 76, respectively, which is coincident with the position of central axes 31, 32, FIG. 3, of rollers 28, 30, and preferably coplanar with roller plane 44 when rollers 28, 30 are positioned within longitudinal opening 34. Diameter D3 is slightly smaller than the outer diameter D1 of a corresponding roller end 66, 68, the outer roller diameter D1, FIG. 3, being measured in an uncompressed state. This undersizing of each circular opening 70, 72 provides an interference fit between the rollers 28, 30 and sidewall 16 when the roller ends 66, 68 are inserted into recess 64. Circular sections 70, 72 terminate at back surfaces 82, 84 which define the rear portions of recess 64. A similar recess (not shown) is provided in sidewall 18 to accommodate roller ends 67, 69 of rollers 28, 30 respectively.

Each roller end 66, 68 is partially, but not fully engaged into recess 64, creating gaps 94, 96 between the roller ends 66, 68 and back surfaces 82, 84 respectively. Similar gaps 95, 97 are provided between roller ends 67, 69 and back surfaces 83, 85, respectively. Referring to FIG. 5, the spacing L4 of each gap provides sufficient margin for longitudinal roller misalignment, and minimizes or avoids premature wearability of the roller ends 66, 68 against the back surfaces 82, 84. Providing gaps 94, 96 between the roller ends and the back surfaces of each sidewall 16, 18 also allows each roller 28, 30 to "float" in a longitudinal direction along central axes 31, 32. In the embodiment illustrated, each gap is approximately 0.062" (0.157 cm) in depth, though this distance can be varied. By positioning rollers 28, 30 within the sidewalls 16, 18 as described, neither the length of the rollers or the exact position of the roller ends relative to the sidewall or to each other become critical parameters for providing a sealing means at this interface as with other known thru-wall structures.

Referring to FIGS. 5 and 6, recessed portion 64 is preferably defined as a single opening, having a substantially figure-eight configuration over the distance L2 in which roller ends 66, 68 equally extend into sidewall 16.

As shown in FIG. 5, roller end 66 is inset an additional distance L3 into sidewall 16. Because a tight circumferential seal is provided between outer surface 41 and the interior surface 78 of circular section 70, FIG. 6, over this distance, there is no leakage into gap 94. In the embodiment illustrated, roller end 68 extends a distance L2 of 0.25 in (0.63 cm), and roller end 66 extends an additional distance L2+L3 of 0.50 in. (1.27 cm) into sidewall 16. As most clearly shown in FIG. 4, the longitudinal offsetting of roller ends 67, 69 into sidewall 18 is similar, but roller ends 67, 69 are preferably oppositely staggered. This arrangement allows the use of identical rollers which simplifies replacement and maintenance of rollers.

Figure 7:
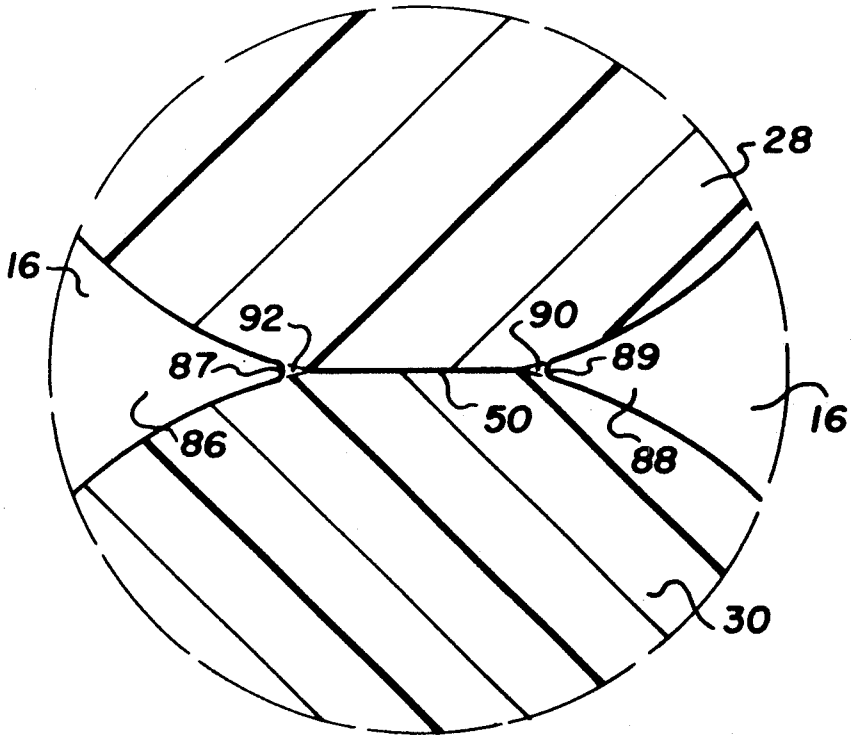
FIG. 7 shows a greatly enlarged cross-sectional view of the nip of the rollers as taken along line 7—7 of FIG. 6.

Referring to FIGS. 6 and 7, the interior sidewalls 78, 80 of the defined circular portions 70, 72 respectively, overlap thereby forming the two protrusions 86, 88 which define the preferred figure eight configuration of recess 64. Protrusions 86, 88 each extend to form two rounded edges 87, 89 which are adjacent the nip 50 of the rollers 28, 30 when rollers 28,30 are inserted into recess 64, as shown most clearly in FIG. 7. Though edges 87, 89 could be made to conform more closely to the nip 50 to provide a more complete circumferential seal, it is preferable that edges 87, 89 be rounded because a sharpened corner could more easily tear a roller surface. The effect of rounding the edges 87, 89 is that two small openings 90 and 92 adjacent nip 50 are formed.

The compliancy of roller sublayers 37, 39 allows each roller end 66, 68 to be radially compressed to accommodate the roller ends within recess 64. The effect of the interference fit is that fluid seals are formed between the outer surfaces 41, 43 of rollers 28, 30 and adjacent inner peripheries 86, 88, respectively as well as between the outer surfaces 41, 43 of the rollers 28, 30 which are in contact at the nip 50. Similar seals (not shown) are provided at sidewall 18. Further, outer layer 41, 43 assists the roller ends to be easily rotated even though compressive forces are created due to the interference fit.

Further, the actual amount of interference between roller ends 66, 68 and recess 64 can be varied, provided that a nominal amount of interference is provided for. The 0.010 in (0.254 cm) interference between recess 64 and rollers 28, 30 has been found to provide the desired sealing while still allowing the structure to be manufactured and assembled at a relatively low cost. The compliant nature of sublayer 37, 39 coupled with the wear resistance and low coefficient of friction of outer layer 41, 43 produce an effective liquid seal without exact dimensioning or tolerancing of the component parts of previously known wall structures.

Figure 9:
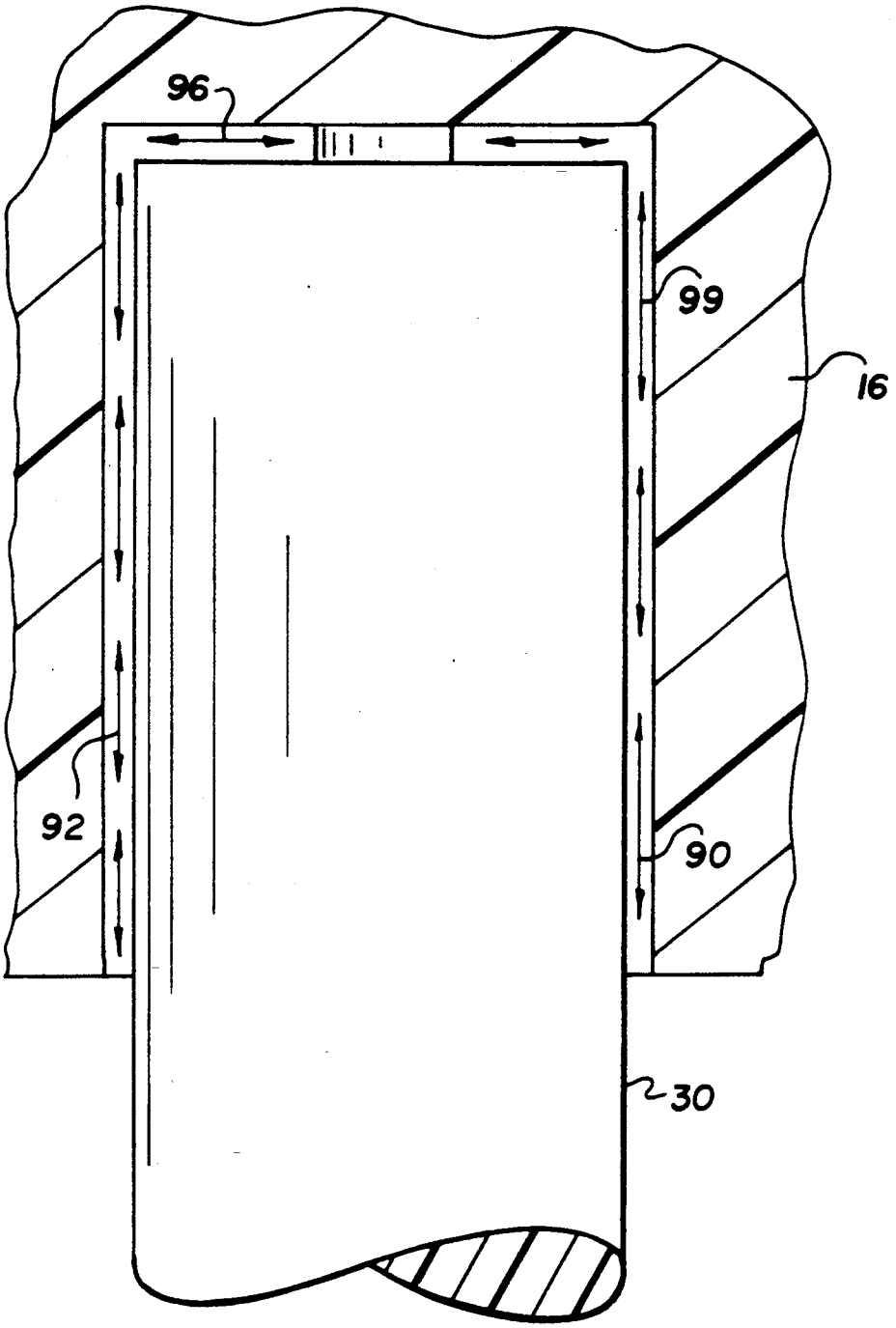
FIG. 9 is an enlarged partial cross-sectional view taken along line 9—9 of FIG. 5, illustrating a portion of the roller end-sidewall interface.

Though an almost totally circumferential fluid seal is created at the roller end-sidewall interface, a small amount of liquid could conceivably migrate through the wall structure described in the embodiment illustrated. Referring to FIGS. 7 and 9, openings 90, 92 are substantially triangularly-shaped channels, disposed on either side of the nip 50 of rollers 28, 30, which extend inwardly into sidewall 16 and terminate at gap 96. Because of the longitudinal offsetting of roller end 66 relative to roller end 68, a seal is provided over the entirety of circular opening 70 over the distance L4 which roller end 66 additionally extends into sidewall 16. This is shown most clearly in FIG. 9.

Referring to FIG. 9, channels 90, 92 provide a potential leak path indicated by arrows 99 by which processing liquid (not shown) could possibly migrate through wall structure 100. In the path described by arrows 99, a processing liquid (not shown) can enter sidewall 16 through either channel 90 or 92, flow around the roller end 66 through gap 96 and exit through the remaining channel 92 or 90 thereby migrating through wall structure 100. In the embodiment illustrated the potential leak path represented is relatively small, however, in that each channel 90, 92 is defined by a substantially triangular opening having dimensions of approximately 0.015 in×0.03 in×0.25 in (0.038 cm×0.076 cm×0.635 cm).

Because increasing the distance L2 which roller ends 66, 68 extend into sidewall 16 does not significantly increase the drive torque required to rotate rollers 28, 30 due to the low coefficient of friction of outer layers 41, 43, the potential leak path 99 can optionally be lengthened by increasing this distance, thereby further minimizing the amount of potential leakage through wall structure 100.

Alternatively, or in addition to lengthening leak path 99, a washer (not shown), such as made from a closed cell foam or other light weight material or other gasketing material can be positioned within gap 96 to block the small quantity of liquid which could enter from either channel 90 or 92. A similar arrangement (not shown) can be provided within sidewall 18.

Figure 8:
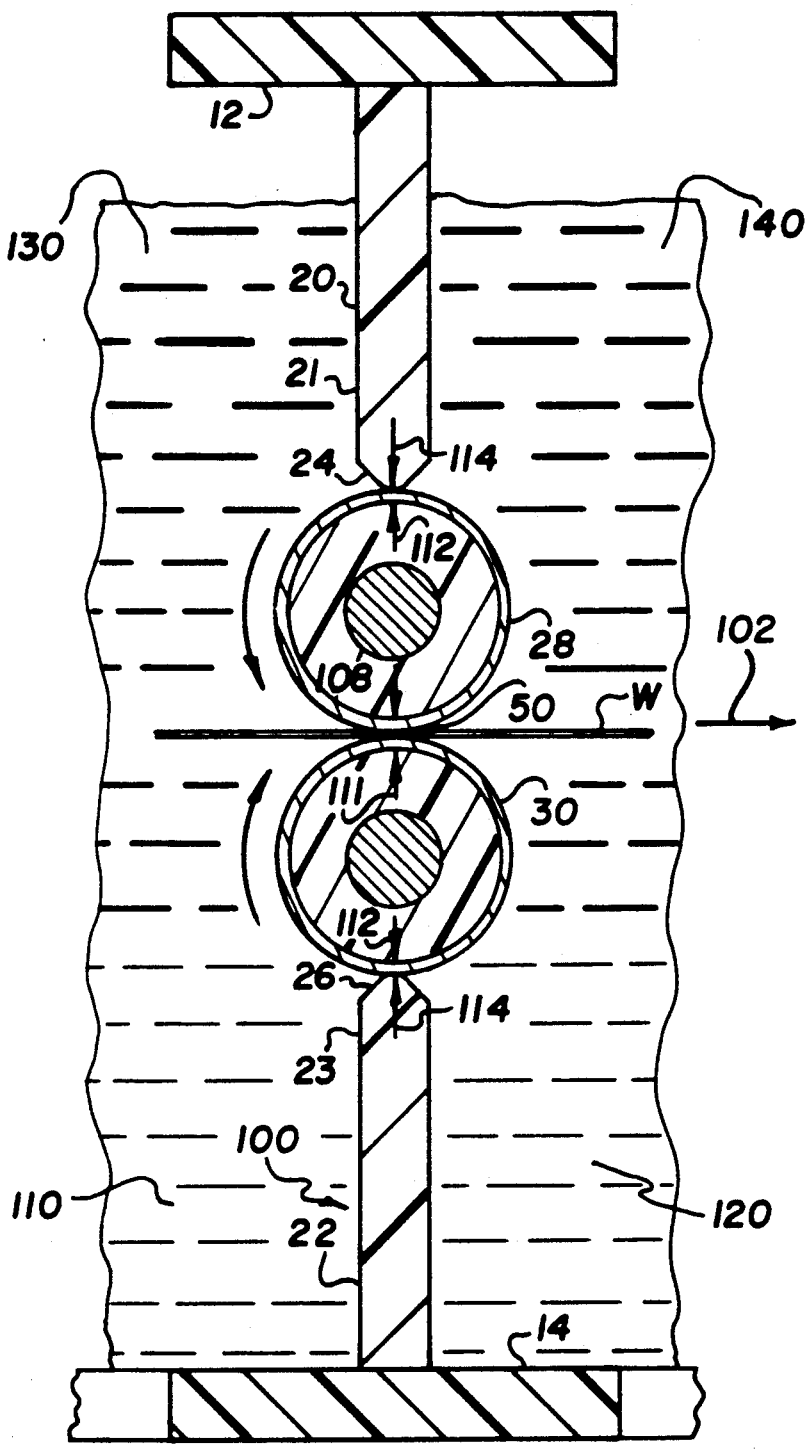
FIG. 8 is a side elevational view, taken in section, of a processor having the wall structure shown in FIGS. 1–7.

In operation, the present invention can be described in the embodiment shown in FIG. 8 wherein a wall structure 100, as described above divides adjacent chambers 110, 120, each adjacent chamber being filled with a processing fluid 130, 140 respectively. In the embodiment illustrated, a continuous web W of photosensitive material is introduced between parallel contacting rollers 28, 30 though individual sheets of material can also be suitably introduced using the described wall structure. The rollers being driven by left and right hand gear trains, see FIG. 1 and 3, cooperate to permit rollers 28, 30 to act as a web transport means. In the embodiment illustrated, roller 28 is rotating in a counterclockwise direction and roller 30 is driven to rotate in a clockwise direction so as to provide a transport direction from chamber 110 toward chamber 120 as shown in FIG. 11. The direction of rollers 28, 30, however, can be varied for processing apparatus having any known processing path. The web W, having a typical thickness of 0.007 in (0.018 cm) in the embodiment illustrated, is allowed to pass between rollers 28, 30 at nip 50 to be taken up and horizontally transported into chamber 120 due to the compliancy of sublayers 37, 39 which radially deform in the presence of the introduced web. This further compresses the rollers 28, 30, but because the compliant sublayers 37, 39 absorb the additional compressive forces which are created there is no substantial increase in drive torque required to rotate the rollers 28, 30. In addition, the low coefficient of friction of outer layer 41, 43 allows the photosensitive web to easily pass through nip 50 per arrow 102 with a reduced chance of the web adhering to the rollers or premature stretching or tearing of the web. The compressive forces created provide an effective seal at nip 50 between contacting rollers 28, 30, while the low coefficient of friction of outer layer 41, 43 assists the rollers 28, 30 so that they can be easily rotated despite the action of the compressive forces, represented by arrows 108, 111. This minimizes significant quantities of processing liquid 130 from passing between rollers 32, 34 and into adjacent chamber 120.

Likewise, the interference fit of rollers 28, 30 into opening 34 provides a similar seal between the individual rollers 28, 30 and adjacent wiping surfaces 24, 26. As most clearly seen in FIG. 8, processing liquid 140, present in chamber 120 and carried by the rotation of rollers 28, 30 is squeegeed from the outer roller surfaces 41, 43 by wiping surfaces 24, 26 due to compressive contact with rollers 32, 34 respectively, thereby preventing significant migration of liquid into processing chamber 110. The compressive forces created due to the interference fit are indicated by arrows 112 and 114. Other contact means between rollers 28, 30 and upper and lower wall sections 12, 14 can be provided, though in the preferred embodiment illustrated wiping surfaces 24, 26 provide a single point of contact which produces a minimal amount of roller wear.

At each roller end-sidewall interface processing liquid 130 is prevented from substantially migrating through wall structure 100 and into chamber 120 by the placement of roller ends 66, 68 and 67, 69 into sidewalls 16, 18 respectively. As shown most clearly in FIGS. 4 and 5, by providing a recess 64 in sidewall 16 which is smaller than the combined outer diameters D2 of roller ends 66, 68, an interference fit is created between the outer surfaces 41, 43 of each roller end 66, 68 and sidewall 16, placing the interior sidewalls 78, 80 of the recessed portion 64 and the outer surfaces 41, 43 of roller ends 66, 68 into compressive contact. The creation of the compressive contact provides seals along those surfaces brought into contact as well as at the nip 50 of roller ends 66, 68. This is most clearly seen in FIG. 5.

Figure 10:
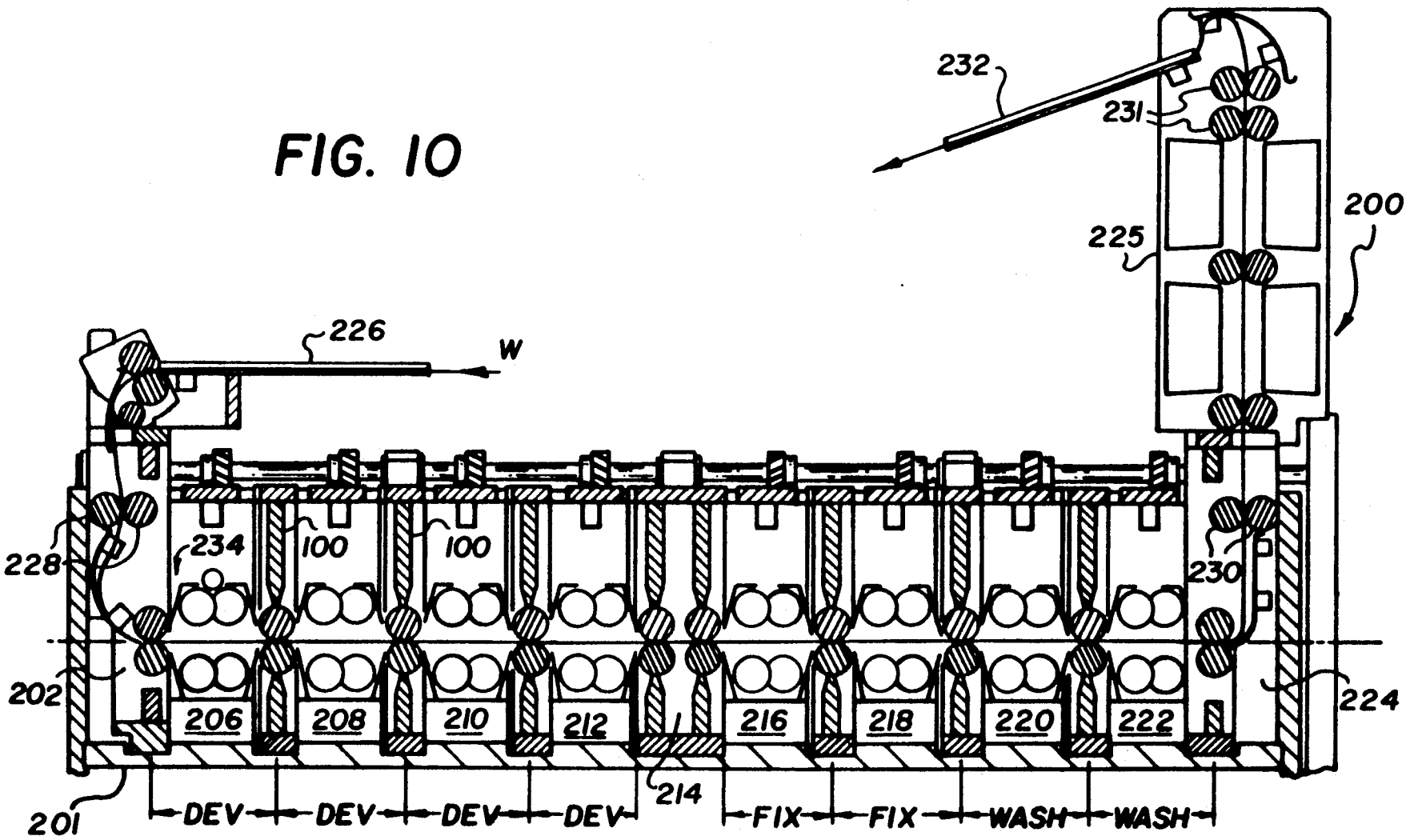
FIG. 10 is a side elevational view, taken in section, of a processing apparatus using a plurality of the wall structures shown in FIG. 1–9.

The utility of a wall structure described herein can also be shown in the context of processing apparatus 200, illustrated in FIG. 10.

Briefly, processor 200 consists of an elongated housing 201, divided by suitable partitions to define a web entrance chamber 202, a series of developing chambers 206, 208, 210 and 212, a rinse chamber 214, a series of fixing chambers 216 and 218, a series of wash chambers 220 and 222, a web exit chamber 224 and a final drying module 225. The web (W) is fed into the apparatus 200 by an entrance chute 226 and transported through entrance chamber 202 and through each chamber by means of transport rollers 228. The web is transported from the final wash chamber 222 to the drying module 225 by transport rollers 230 from which it is exited by additional rollers 231 and 232.

To effectively process the web in each processing chamber, some or all of the chambers 206–212 and 216–222 may contain a web processing module 234 described in greater detail in copending and commonly assigned application, Ser. No. 08/054,810, entitled "Processing Apparatus", and filed by Mark J. Devaney, Jr., John S. Lercher, Lee F. Frank, Paul W. Wagner and Jeffrey L. Helfer, previously incorporated above. It can be seen, however, that the present invention can be used in conjunction with modules 234 or other means of applying processing liquid to a web passing through a chamber.

Each processing chamber 206–212 and 216–222 are separated by the wall structures 100 described above and referred to in FIG. 1–9. The wall structures 100 provide a means of horizontally transporting the web of photosensitive material between adjacent chambers which can be filled with a processing liquid, while also providing an effective sealing means to prevent cross-contamination between the chambers.

Further, each wall structure 100 can be independently removed and positioned within processor 200 to provide for a number of possible processing arrays by which the size and number of processing chambers can be varied. These features with respect to the processor shown in FIG. 10 are more fully described in the commonly assigned and copending applications, Ser. No. 08/054,810, entitled "Processing Apparatus" by Mark J. Devaney, Jr. and John S. Lercher, Lee F. Frank, Paul W. Wagner and Jeffrey L. Helfer, also previously referred to above. The effect of the modularity and indexing features described by this reference is that the apparatus 200 becomes more versatile such that differing photosensitive materials can be processed using the same piece of apparatus.

The invention has been described in detail with particular reference to preferred embodiments thereof, but it will be understood that variations and modifications can be effected within the scope of the invention.

We claim:

1. An internal wall structure for use in an apparatus for processing photosensitive material, said apparatus having at least one chamber for containing a processing fluid, said wall structure forming a portion of said chamber and for allowing said photosensitive material to pass therethrough, said wall structure comprising a top and a bottom surface and a pair of side surfaces defining a first opening, and at least one pair of substantially parallel contacting rollers, comprising a first and a second roller, said roller pair being positioned in said first opening so that said rollers central longitudinal axis is aligned with the centerline of the wall structure, the combined outer diameters of said roller pair being slightly greater than said first opening when said rollers are not positioned in said wall structure, said rollers being radially deformable so as to fit said roller pair within said first opening, said side surfaces each having a recessed portion for receiving the roller ends, each said recessed portion defining a second opening which is slightly smaller than the outer diameter of said roller ends.

2. A wall structure as claimed in claim 1 wherein said rollers comprise a compliant sublayer, said sublayer extending substantially over the length of said rollers and surrounded by an outer layer made of material having a low coefficient of friction.

3. A wall structure as claimed in claim 1 or 2 wherein said rollers further comprise a rigid interior core section, said core section extending over the length of a said roller.

4. A wall structure as claimed in claim 1 further comprising means for rotatably driving said rollers in order to provide a transport means for photosensitive material introduced between said rollers.

5. A wall structure as claimed in claim 2 wherein said sublayer is made of silicone rubber.

6. A wall structure as claimed in claim 2 wherein said outer layer is made of PFA.

7. A wall structure as claimed in claim 1 wherein the end of one said roller is longitudinally offset from the end of said other roller of said roller pair within said recessed portion.

8. A wall structure as claimed in claim 1 wherein each said recessed portion is defined by a pair of substantially circular openings, each said opening being sized to receive a roller end and having a diameter which is slightly smaller than the diameter of a roller end, each said roller end being radially deformable so as to fit within a said opening.

9. A wall structure as claimed in claim 8 wherein said circular openings overlap so as to define a substantially figure-eight configuration for receiving the roller ends of said roller pair.

10. A wall structure as claimed in claim 9, said roller ends being positioned within said recessed portions so that said rollers are axially translatable within said wall structure.

11. A wall structure as claimed in claim 3 wherein said compliant material having a Shore A hardness in the range of about 20 to 40.

12. A wall structure as claimed in claim 2 wherein said compliant sublayer is at least 0.125" thick.

13. A wall structure as claimed in claim 2 wherein said outer layer has a coefficient of friction in the range of about 0.05 to 0.10.

14. An apparatus for processing photosensitive material having a plurality of chambers for containing a processing fluid, and at least one internal wall structure for dividing at least two of said plurality of chambers, said at least one wall structure forming a portion of a said chamber and for allowing said photosensitive material to pass therethrough, said at least one wall structure having a top and a bottom surface and a pair of side surfaces defining a first opening, and at least one pair of substantially parallel contacting rollers comprising a first and a second roller, said rollers being positioned in said first opening so that said rollers central longitudinal axis is aligned with the centerline of said wall structure, the combined outer diameters being slightly greater than said first opening when said rollers are not positioned within said first opening, said rollers being radially deformable so as to fit said roller pair within said first opening, said side surfaces each having a recessed portion for receiving the roller ends, each said recessed portion defining a second opening which is slightly smaller than the outer diameter of said roller ends.

15. An apparatus as claimed in claim 14 wherein at least one said roller comprises a compliant sublayer, said sublayer extending substantially over the length of said roller and surrounded by an outer layer made of material having a low coefficient of friction.

16. An apparatus as claimed in claim 14 wherein said rollers further comprise an interior core section, said core section extending over the length of a said roller.

17. An apparatus as claimed in claim 14 further comprising means for rotatably driving said rollers in order to provide a transport means for photosensitive material introduced between said rollers.

18. An apparatus as claimed in claim 15 wherein said sublayer is made of silicone rubber.

19. An apparatus as claimed in claim 15 wherein said outer layer is made of PFA.

20. An apparatus as claimed in claim 14 wherein the roller end of said first roller is longitudinally offset from the end of said second roller within said recessed portion.

21. An apparatus as claimed in claim 14, wherein each said recessed portion of said at least one wall structure is defined by a pair of substantially circular openings, each said opening being sized to receive a roller end and having a diameter which is slightly smaller than the diameter of a roller end, each said roller end being radially deformable so as to fit within a said opening.

22. An apparatus as claimed in claim 21 wherein said circular openings overlap so as to define a substantially figure-eight configuration for receiving the roller ends of a said roller pair.

23. An apparatus as claimed in claim 22, said rollers being positioned within said wall structures so as to be axially translatable.

24. An apparatus as claimed in claim 15 wherein said compliant sublayer is made of material having a Shore A hardness in the range of about 20 to 40.

25. An apparatus as claimed in claim 24 wherein said compliant sublayer is at least 0.125" thick.

26. An apparatus as claimed in claim 15 wherein said outer layer has a coefficient of friction in the range of about 0.05 to 0.10.

* * * * *